United States Patent [19]

Petersen et al.

[11] Patent Number: 4,522,053

[45] Date of Patent: Jun. 11, 1985

[54] ELECTRICAL CONNECTOR PROGRAMMING TOOL

[75] Inventors: Richard W. Petersen, Taunton; John M. Pierini, South Attleboro, both of Mass.; Herbert G. Yeo, Port Charlotte, Fla.

[73] Assignee: Augat Inc., Attleboro, Mass.

[21] Appl. No.: 447,301

[22] Filed: Dec. 6, 1982

[51] Int. Cl.[3] ..... B21D 5/04; B21D 53/36

[52] U.S. Cl. ..... 720/316; 72/293; 72/477; 72/478; 29/874; 29/884; 29/882; 337/18 C

[58] Field of Search ..... 72/316, 293, 482, 481, 72/477, 478, 389, 462, 404; 29/847, 874, 884, 29/882; 339/18 R, 18 C, 18 B; 83/700

[56] References Cited

U.S. PATENT DOCUMENTS

| | | | |
|---|---|---|---|
| 144,969 | 11/1873 | Evans | 72/404 |
| 1,410,692 | 3/1922 | McIlvried | 72/481 |
| 1,569,865 | 1/1926 | Lermer | 72/389 |
| 1,939,478 | 12/1933 | Whistler | 83/700 |
| 3,029,677 | 4/1962 | Metzger | 83/700 |
| 3,149,524 | 9/1964 | Vecchi | 83/700 |
| 3,226,802 | 1/1966 | Goodwin, Jr. et al. | 29/847 |
| 3,468,024 | 9/1969 | Yonkers | 29/874 |
| 3,474,657 | 10/1969 | Spiegel | 72/478 |
| 4,095,862 | 6/1978 | Hatch | 339/14 R |
| 4,347,747 | 9/1982 | Galiger | 72/389 |

FOREIGN PATENT DOCUMENTS

| | | | |
|---|---|---|---|
| 543473 | 5/1956 | Italy | 83/700 |
| 415252 | 8/1934 | United Kingdom | 83/700 |

*Primary Examiner*—Daniel C. Crane

*Attorney, Agent, or Firm*—Weingarten, Schurgin Gagnebin & Hayes

[57] ABSTRACT

An electrical connector programming tool is provided which is operable "in-the-field" to program the bus bar of an electrical connector for a flat ribbon cable. The tool includes a tray subassembly adapted to removably retain a connector having a bus bar to be programmed, and a head subassembly having a plurality of selectively extendable tongues adapted to program the bus bar.

8 Claims, 6 Drawing Figures

ELECTRICAL CONNECTOR PROGRAMMING TOOL

FIELD OF THE INVENTION

This invention is directed to the field of tools, and more particularly, to an electrical connector programming tool for programming the bus bar of an electrical connector for a flat ribbon cable.

BACKGROUND OF THE INVENTION

Electrical connectors for flat ribbon cables are operative to provide a mass termination of the signal wires of a flat ribbon cable. Typically, adjacent pairs of the conductor wires of the flat ribbon cable are terminated by connecting individual ones of the conductors of successive pairs respectively to an I/O contact and to ground for removing electrical crosstalk, among other things. In the connector of U.S. Pat. No. 4,095,862, incorporated herein by reference, a connector housing halfshell is provided having a first row of upstanding, electrically isolated, longitudinally spaced apart signal contacts electrically connected to a corresponding I/O contact. Individual ones of the signal contacts are aligned to receive alternate conductor wires of the flat ribbon cable for termination thereof to a corresponding I/O contact. A bus bar is transversely positioned in the housing halfshell in spaced apart relation to the first row of signal contacts. The bus bar has a second row of upstanding, electrically connected, and longitudinally spaced apart ground output contacts, and a third row of upstanding, electrically connected, and longitudinally spaced apart ground contacts. Individual ones of the third row of upstanding ground contacts are aligned to receive alternate ones of the remaining conductors of the successive pairs of the flat ribbon cable for termination of corresponding ones thereof to the ground bus.

Individual ones of the second row of upstanding ground output contacts are aligned with a different one of the signal contacts, and either are programmable to receive corresponding ones of the conductors for termination thereof to the ground bus and thereby selectively to provide at least one grounded I/O contact, or are programmable to an electrically inoperative condition. Prior to assembling the connector, the bus bar is preferably inserted into a die programmed not to remove those ground output contacts which correspond to the selected I/O coupling elements to be grounded, while the non-selected ground output contacts are removed from the bus entirely. The programmed bus bar is thereafter mounted in the connector housing with the second row of upstanding ground output contacts positioned interiorly of the row of upstanding ground contacts providing a connector having standardized bus bar programming. However, in many applications, it is often desirable to have at the ground potential an I/O coupling element that does not correspond to the commercially available pre-programmed I/O coupling elements. In these instances, a special order is required necessitating costly time delays, tooling, and handling.

SUMMARY OF THE INVENTION

According to the present invention, a bus bar programming tool is provided which can be a readily employed "in-the-field" to accommodate the bus bar programming requirements of a particular application, and an improved electrical connector is provided which can be mass produced prior to bus bar programming. The bus bar of the improved connector is mounted in the connector housing with the row of upstanding ground output contacts exteriorly spaced of the row of upstanding ground contacts in a position which is readily accessable for "in-the-field" bus bar programming. The electrical connector programming tool is provided with a tray subassembly adapted to accept and removably retain the connector to be programmed, and a head subassembly having a plurality of spaced apart tongues programmable between a first position adapted to render the corresponding upstanding ground output contact to an electrically inoperative condition, and a second position adapted to render the corresponding upstanding ground output contact to an electrically operative condition. Programming is effected by selectively positioning individual ones of the tongues to either the first position or the second position.

In the preferred embodiment, the tray subassembly includes a cradle having a face inclined at an angle selected to impart a lateral and downward force to the upstanding ground output contacts upon tongue impact to effect their bending downwardly and laterally to the electrically inoperative condition. Adjustable clamps are provided on the cradle to removably retain connectors of variable physical dimensions. The head subassembly includes a frame member having a slidably mounted and longitudinally extending shaft about which the selectively extendable tongues are rotatably mounted between an extended position, adapted to impact corresponding ones of the upstanding ground output contacts, and a retracted position, adapted not to impact the corresponding ground output contacts. A longitudinally extending locking pin is slidably mounted in the frame and is adapted to retain the tongues in a particular programmed configuration.

BRIEF DESCRIPTION OF THE DRAWINGS

The invention will become better understood by referring to the following exemplary and non-limiting detailed description of the preferred embodiment and to the drawings wherein.

DETAILED DESCRIPTION OF THE PREFERRED EMBODIMENT

Figure 1A:
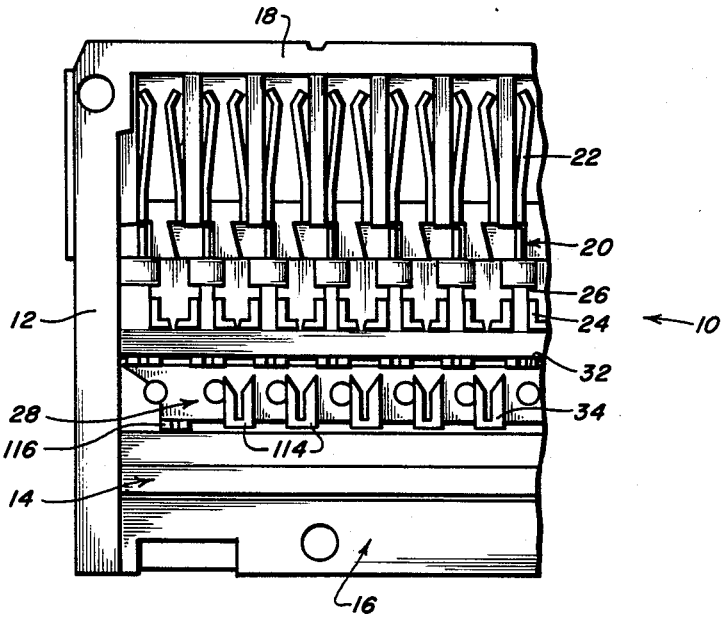
FIG. 1 shows in FIG. 1A a plan view and shows in FIG. 1B a perspective view of an improved connector for a flat ribbon cable according to the present invention.
Figure 1B:
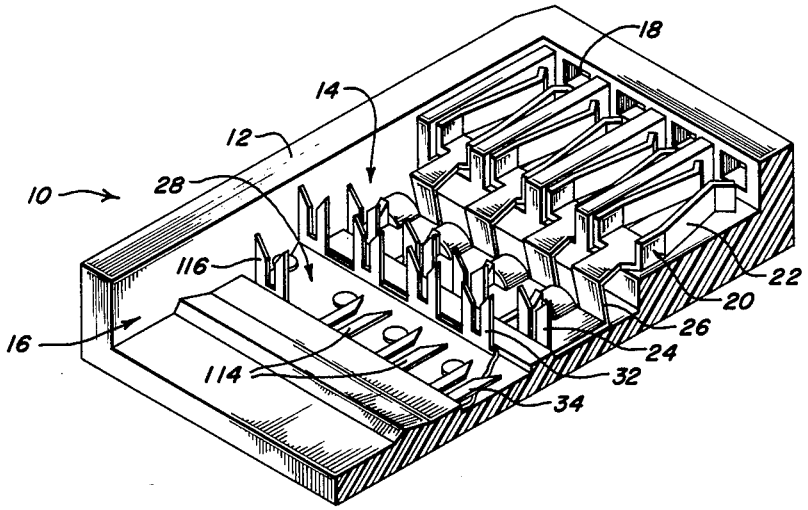

Referring now to FIGS. 1A and 1B, generally designated at 10 is the improved electrical connector for a flat ribbon cable of the present invention. The connector 10 has a dielectric housing 12 defining a cavity generally designated 14, an opening generally designated 16 adapted to receive a flat ribbon cable having alternating ground and signal wires sheathed in an insulative material (not shown), and a plurality of connector slots 18 for receiving connection elements therethrough. A plurality of metallic I/O contacts generally designated 20 are positioned within the cavity 14 each having a rear portion 22 and a forward portion 24 electrically joined by a segment 26. The rear portion 22 has spring members adapted to receive a connector pin and the forward portion 24 thereof defines a first row of upstanding spaced apart signal contacts adapted to pierce the insulative sheath of a conductor and contact the conductive wire contained therein. A ground bus generally designated 28 is positioned in the cavity 14 parallel with and in spaced apart relation to the first row 24 of upstanding signal contacts. The ground bus 28 has a second row 32 of upstanding spaced apart ground contacts, and a third row 34 of upstanding, spaced apart, programmable ground output contacts. The second row 32 of upstanding ground contacts is interiorly positioned to the row 34 of upstanding ground output contacts.

The signal contacts of the first row 24 are aligned to receive alternate conductors of successive pairs of the conductors of the flat ribbon cable for termination thereof to the corresonding I/O contact. The upstanding ground contacts of the second row 32 are aligned to receive alternate ones of the remaining conductors of the flat ribbon cable for termination thereof to the ground bus. The ground output contacts of the third row 34 are aligned with the signal contacts of the first row 24 and are programmable in a manner to be described to receive corresponding ones of the conductor wires for providing selective termination thereof to the ground bus 30. It is to be noted that the electrical connector 10 for a flat ribbon cable of the present invention is substantially the same as the electrical connector shown and described in the above referenced patent except that the ground bus 30 has been mounted in the cavity 14 such that the position of the row of upstanding ground contacts and the row of upstanding ground output contacts is reversed.

Figure 2A:
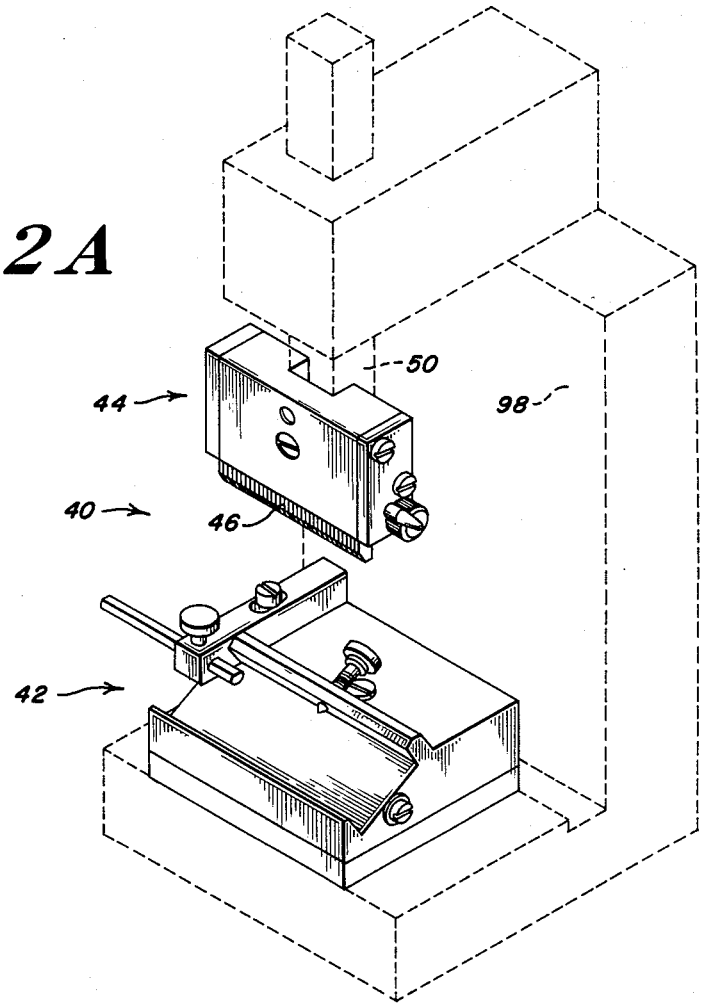
FIG. 2 shows in FIG. 2A a perspective view of an electrical connector programming tool, shows in FIG. 2B an exploded perspective view of a head subassembly of the electrical connector programming tool, and shows in FIG. 2C an exploded perspective view of a tray subassembly of the electrical connector programming tool according to the present invention.

Referring now to FIG. 2A, generally designated at 40 is a perspective view of an electrical connector programming tool according to the present invention. The electrical connector programming tool 40 includes a tray subassembly generally designated 42 for removably retaining connectors of variable physical dimensions, and a head subassembly generally designated 44 having a plurality of programmable tongues 46. The tray subassembly 42 is fastened to the bottom portion of a platform 48, shown dashed, and the head subassembly 44 is fastened to an arm 50 which is slidably mounted to the platform 48. Any suitable mechanical, pneumatic, hydraulic, or electrical means, not shown, may be employed to controllably move the arm 50 to effect the upward and downward displacement of the plurality of programmable tongues of the head subassembly. The platform 48 may comprise, for example, a manually operated bench or a pneumatic production tool.

Figure 2B:
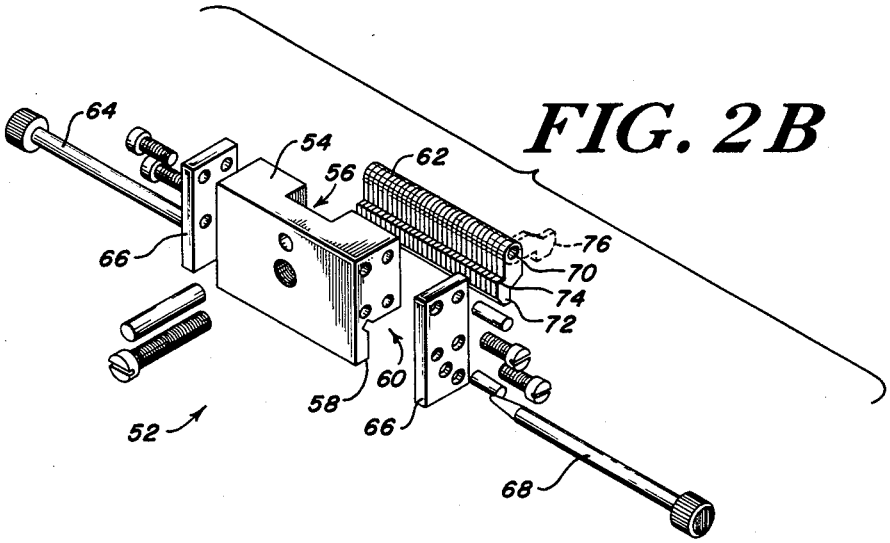

Referring now to FIG. 2B, generally shown at 52 is an exploded perspective view of a head subassembly of an electrical connector programming tool according to the present invention. The head subassembly 52 includes a frame 54 having a central and transversly extending slot 56 adapted to receive the arm 50 (FIG. 2A) and a longitudinally extending flange 58 defining a mouth 60 having a "L"-shaped cross-section. A plurality of tongues 62 are rotatable mounted on an elongated shaft 64 slidably mounted longitudinally in the mouth 60 through apertures provided therefor in ears 66 which are respectively fastened one to each end of the frame 54. The tongues are provided proximate an end thereof with a hole 70 adapted to accept the shaft 64, with an impacting surface 72 on the other end thereof adapted to impact corresponding ones of the upstanding ground output contacts, and a shoulder portion 74 intermediate the ends adapted to abut the flange 58 when programmed to be in the extended position.

A longitudinally extending locking pin 68 is slidably mounted through apertures provided therefor in the ears 66 in the mouth 60 in a position adapted to abut the tongues 66 to hold selected ones thereof in a retained position, as shown dashed at 76, and to hold selected ones thereof in the extended position. Threaded fasteners, or any other suitable means, can be employed to fasten the head subassembly to the slidable arm 50 (FIG. 2A) and threaded fasteners, or any other suitable means, can be employed to fasten the ears to the frame.

Figure 2C:
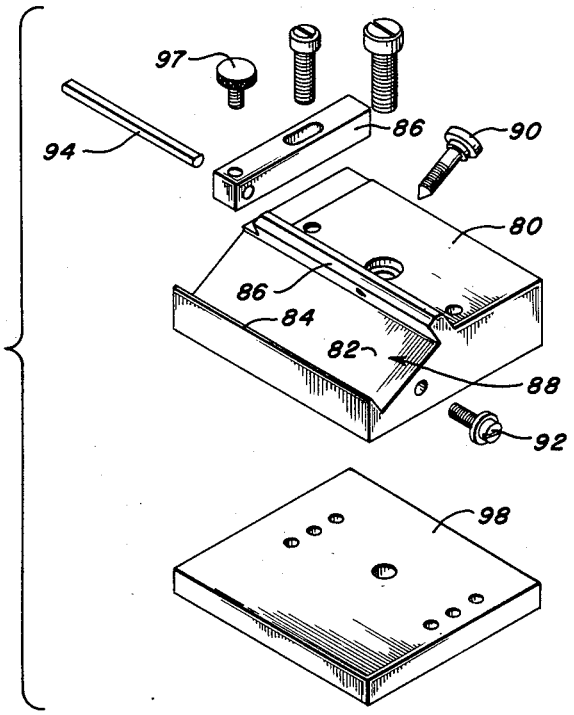

Referring now to FIG. 2C, generally designated at 78 is an exploded perspective view of a tray subassembly of the bus bar programming tool according to the present invention. The tray 78 includes a cradle 80 having an inclined face 82 terminated by spaced apart and longitudinally extending edge flanges 84 and 86 definging a slot 88. The slot 88 is dimentioned to receive a connector to be programmed. The face 82 is inclined at such an angle to the vertical that the force of the impact of individual ones of those tongues selected to be in the extended position on corresponding upstanding ground output contacts effects a downward and to the side bending motion thereof to an electrically inoperative condition. It will be appreciated that a slot insert, not shown, adapted to accept an electrical connector having a different package geometry, such as a DIP connector body, can be employed without departing from the inventive concept.

A threaded member 90 is controllably turned in a threaded bore provided in the flange 86 to abut and frictionally engage the connector to be programmed at a point along the top edge thereof. An abutment 92 is removably fastened to a side of the slot 88 to prevent the lateral motion of the connector in the cradle in one direction. An arm 94 is slidably mounted in a transverse leg 86 which is threadably fastened through a slot in the leg 86 to the cradle 80. The arm 94 is frictionally engaged about a point along its length by a threaded member 97 to provide an adjustable abutment to prevent the lateral motion of the connector to be programmed in the opposite direction. The cradle 80 is threadably fastened to the platform 48 (FIG. 2A) via a base plate 98.

Figure 3:
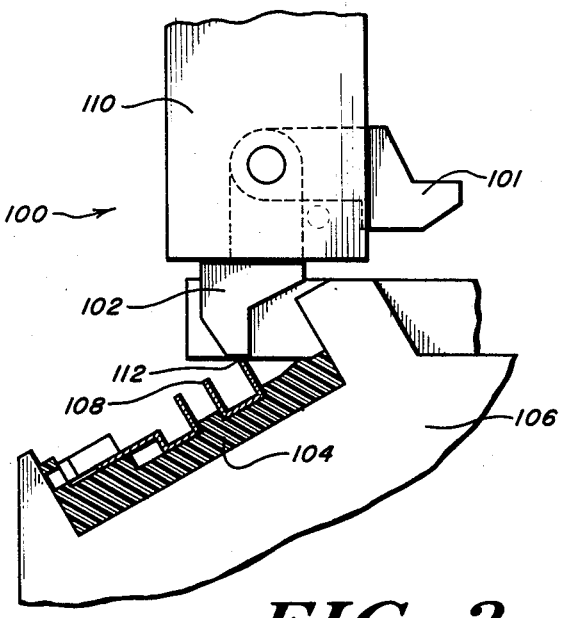
FIG. 3 shows a diagramatic view illustrating the operation of an electrical connector programming tool for programming a bus bar of an electrical connector for a flat ribbon cable according to the present invention.

Referring now to FIG. 3, generally shown at 100 is a diagramatic view depicting the operation of the bus bar programming tool at the moment of impact of the programmable tongues with corresponding ones of the row of upstanding ground output contacts. Those tongues which correspond to the ground output contacts selected to provide a grounded I/O terminal are locked in a retained position as shown at 101, while the remaining tongues are locked in an extended position as shown at 102. The connector 104 to be programmed is removably retained in the cradle 106 with its row of upstanding ground output contacts 108 upwardly exposed in a position to be impacted. The head subassembly 110 is then controllably moved downwardly such that the tongues selected to be in the extended position impact corresponding upstanding ground output contacts, as shown at 112, and are operative to bend the impacted ground output contacts downwardly and laterally over into an electrically inoperative condition, as shown at 114 in FIG. 1. Those tongues selected to be in the retracted position fail to impact the corresponding ground output contacts, which, as shown at 116 in FIG. 1, remain upstanding in position to accept the corresponding conductors of the flat ribbon cable for termination thereof to the ground potential. The head is then moved upwardly, and the programmed connector is removed from the cradle. The tongues of the head subassembly can then be readily re-programmed to accommodate the bus bar programming configuration called for by a different application.

It will be appreciated that many modifications of the presently disclosed invention can be effected without departing from the scope of the appended claims.

What is claimed is:

1. An electrical connector programming tool for programming an electrical connector for a flat ribbon cable of the type having a bus bar having a plurality of contacts to be programmed that are each normally in an electrically operative upstanding condition, comprising:

a tray subassembly for removably retaining the electrical connector in an orientation where individual ones of the plurality of upstanding contacts are exposed;

a head subssembly having a like plurality of tongues individually corresponding to an associated one of the exposed upstanding contacts for impacting said contacts;

means coupled to said head and to said like plurality of tongues for individually mounting each of said tongues for motion relative to said head between a first preselected position selected to not-impact but allow a corresponding one of the upstanding contacts to remain in the electrically operative upstanding condition and a second preselected position selected to impact a corresponding one of the upstanding contacts and bend it at an angle inclined to the angle of its upstanding condition to an electrically inoperative condition; and means, coupled to said tongues and to said head subassembly for releasably locking said tongues individually in a selected one of said first and said second positions.

2. The electrical connector programming tool of claim 1, wherein said tray subassembly includes a cradle having a slot dimensioned to receive the connector to be programmed; and further includes adjustable clamps for removably retaining connectors of variable physical dimensions.

3. The electrical connector programming tool of claim 2, wherein said slot defines a plane having a normal line thereto, and wherein the normal line to said plane is inclined at a preselected non-zero acute angle to each of said tongues when in said second position.

4. The electrical connector programming tool of claim 1, wherein said tongues are each provided with a hole; and wherein said head subassembly includes a frame member having a shaft upon which said tongues are rotatably mounted via corresponding ones of said holes between said first and said second positions, and means for locking individual ones of said tongues in one of said first and said second positions.

5. The electrical connector programming tool of claim 4, wherein said locking means including a locking pin.

6. A programming tool for bending selected ones of a plurality of contacts of an electrical connector for flat ribbon cables, said contacts being individually bendable from a normal electrically operative upstanding position to an electrically inoperative position defined at an angle to the normal electrically operative upstanding position of the corresponding contact, comprising:

a connector receiving tray for orienting the normally electrically operative upstanding contacts of the connector in an exposed position to be individually selectively bent to their corresponding electrically inoperative position;

an impacting head having a like plurality of tongues and cooperative with said connector receiving tray for bending any selected one or more of the normally upstanding contacts to their corresponding electrically inoperative position by impact from corresponding ones of said tongues;

means coupled to said tongues for mounting said like plurality of tongues to said head individually for motion between a first position that is selected to allow impact of a corresponding contact and bend it to its electrically inoperative position and a second position spacially different from the first position selected not to allow impact of a corresponding tongue and not to bend it to its electrically inoperative condition but to allow it to remain upstanding in its electrically operative position; and means, coupled to said mounting means and to said impacting head for releasably locking said tongues individually in a selected one of their corresponding first and second positions.

7. The invention of claim 6, wherein said impacting head includes a frame; and wherein said means for mounting the tongues for motion between said first position selected to allow impact of a corresponding one of the contacts and said second position selected not to allow impact of the corresponding upstanding contact includes a shaft mounted to the frame, and means for rotatably mounting the tongues to said shaft for motion between said first and said second positions in such a way that the positions are spacially defined at an angle with respect to each other.

8. The invention of claim 6, wherein said impacting head is operative along a preselected direction; and wherein said connector receiving tray includes a planar surface against which the connector abuts such that the normal to the planar surface is generally coincident with the upstanding contacts and makes a preselected non-zero acute angle with said preselected direction.

* * * * *